United States Patent [19]

Donazzan et al.

[11] 4,454,489

[45] Jun. 12, 1984

[54] TEMPERATURE STABILIZED MICROWAVE CAVITIES

[75] Inventors: Amedeo Donazzan, Carnate; Enzo Pomé, Sesto S. Giovanni, both of Italy

[73] Assignee: TELETTRA - Telefonia Elettronica e Radio S.p.A., Milan, Italy

[21] Appl. No.: 279,936

[22] Filed: Jul. 2, 1981

[30] Foreign Application Priority Data

Jul. 16, 1980 [IT] Italy ..... 23476 A/80

[51] Int. Cl.[3] ..... H01P 7/06; H01P 1/207

[52] U.S. Cl. ..... 333/227; 333/208; 333/229; 333/248

[58] Field of Search ..... 333/227, 208–212, 333/229–235, 245, 248; 29/600; 331/96

[56] References Cited

U.S. PATENT DOCUMENTS

| | | | |
|---|---|---|---|
| 2,704,830 | 3/1955 | Rosencrans | 333/231 |
| 3,636,480 | 1/1972 | Hoeck | 333/230 |
| 3,821,669 | 6/1974 | Wuerffel | 333/230 |
| 3,982,215 | 9/1976 | Lo et al. | 29/600 |

FOREIGN PATENT DOCUMENTS

| | | | |
|---|---|---|---|
| 879853 | 6/1953 | Fed. Rep. of Germany | 333/227 |
| 1199908 | 7/1970 | United Kingdom | 333/209 |

*Primary Examiner*—Marvin L. Nussbaum
*Attorney, Agent, or Firm*—Holman & Stern

[57] ABSTRACT

The description covers temperature stabilized resonant microwave cavities not requiring hermetic sealing and easy to be frequency adjusted. Essentially, they consist of a pure quartz body with a metallized surface, except for small superficial areas used for the couplings.

5 Claims, 11 Drawing Figures

Fig 2
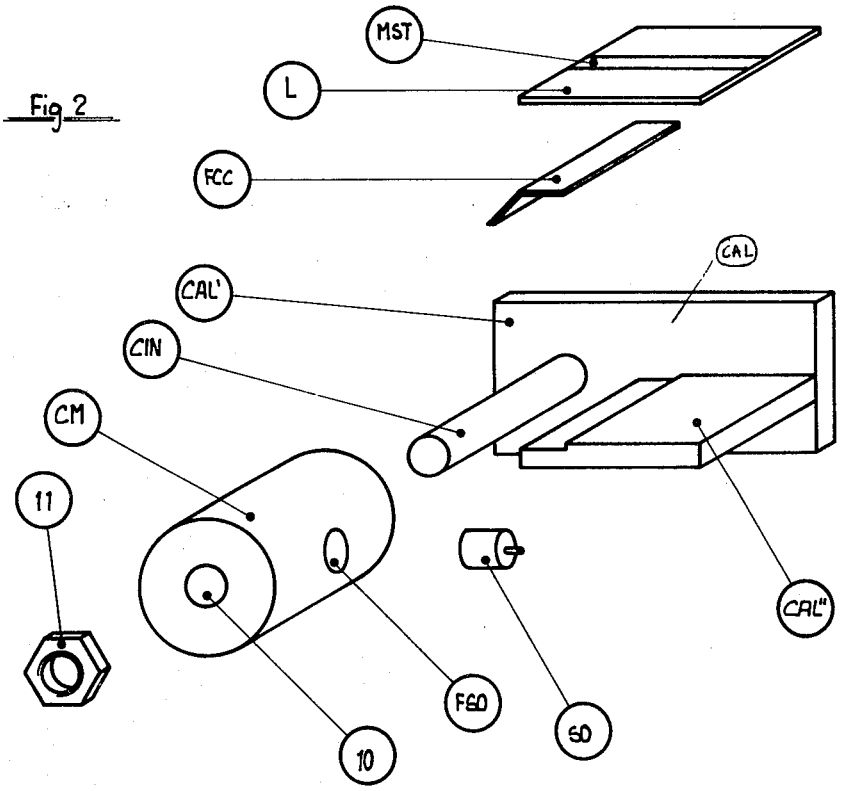
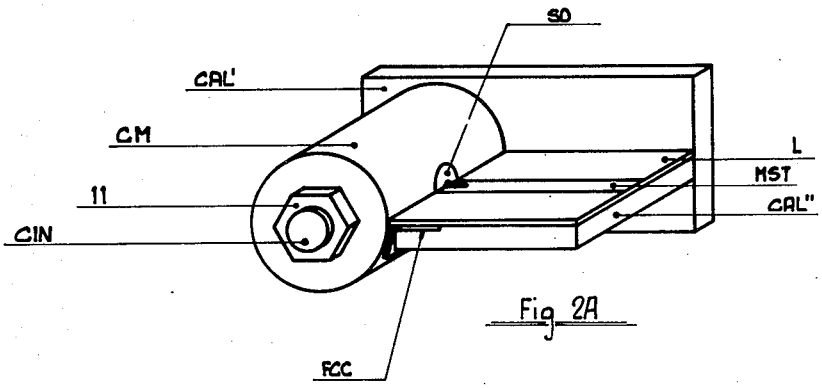
Fig 2A

TEMPERATURE STABILIZED MICROWAVE CAVITIES

BACKGROUND OF THE INVENTION

1. Field of the Invention

The present invention relates to temperature stabilized resonant microwave cavities which do not require hermetic sealing and are easy to be frequency adjusted.

2. Statement of the Prior Art

It is known that at present oscillators and filters implement many types of microwave cavities with a metal wall and filled with gas, the most important ones of which are:

(1) TEM mode coaxial cavity;

(2) $TE_{10}$ mode waveguide cavity;

(3) $TE_{11}$ mode circular waveguide cavity;

(4) $TE_{01}$ mode circular waveguide cavity.

It is also known that the biggest problem to be solved is the cavity resonance frequency stabilization upon a variation of environmental conditions (temperature and humidity) whenever a high frequency stability in the 1 ppm/°C. is to be attained.

In fact, there generally are three fundamental factors affecting the resonance frequency of a cavity, ie:

(1) Cavity metal temperature expansion;

(2) Dielectric constant of the gas filling the cavity;

(3) Load impedance at the ports coupling the cavity to external circuits.

As far as item (3) is concerned, the load effect becomes negligible by adequately reducing the coupling amount towards the load and where necessary, by introducing an isolator between cavity and load.

As to item (1) we point out that for manufacturing a cavity, a metal with a low expansion coefficient vs temperature is being used, i.e. Invar and Super Invar with an expansion coefficient less than/equal to 1.5 ppm/°C. and less than/equal to 0.7 ppm/°C., respectively.

In addition a particular heat treatment for stabilization of these materials is envisaged before and after their being worked. In this way, also the end product maintains the expansion coefficient values specified.

Finally concerning item (2) it is necessary to hermetically seal the cavity (i.e. it must be moist- and gasproof) before filling it with a dry inert gas (e.g. nitrogen) thus cancelling the difference in pressure with respect to the external environment. This solution is particularly hazardous as all soldering of the several parts constituting the cavity as well as the coupling irises and tuning adjustments must be sealed. In this view, Applicants have described in Italian patent application No. 26491 A/79 cavities not requiring gas filling in that the cavity metal wall is fitted with a quartz cylinder. In this patent application No. 26490 A/79 a description was given of cavities having an internal part with minor thickness made of precious alloy (Invar), whereas its external part is thicker and is made of a less precious alloy.

SUMMARY OF THE INVENTION

Whilst continuing their research Applicants succeeded not only in eliminating the cavity inert gas filling, but also in fully suppressing the use of cavity bodies with walls of more or less precious alloys.

The new cavities of this invention no longer have a body with a metal wall in more or less precious alloys, but instead they have a pure amorphous quartz body, the external surface of which has been metallized except for small areas used for couplings.

As the metallized amorphous quartz body of this ivention may have a proper shape and sizes, it is possible to obtain temperature stabilized cavities with a resonance frequency fine adjustment and particularly apt for stable microwave sources by coupling to a suitable active circuit.

With the cavities of this invention it is possible to substitute all microwave cavities with a metal surface i.e:

TEM mode coaxial cavity with $l=\lambda/4$ and $l=\lambda/2$;

$TE_{101}$ mode rectangular waveguide cavity;

$TE_{010}$, $TE_{111}$ and $TE_{011}$ modes circular waveguide cavities.

With respect to the traditional cavities with metal walls used especially the ones implementing alloys at a very low thermal coefficient among the advantages of the cavities of this invention are reported the following ones:

more cost saving due to a drastic simplification of the construction phases in that "difficult" alloys such as Invar and Superinvar are not used, which means saving of purchase and working costs.

This new method makes the invention more competitve even compared with the cavities according to the Applicants' previous patent application.

More cost saving due to elimination of the cavity hermetic sealing. Also in this point of view this invention drastically improves the cavity quality of the above mentioned patent application, i.e.:

(1) it definitely improves the sealing of the cavities;

(2) it permits to create cylinder shaped, rectangular and TEM mode cavities, whereas the cavities of the previous patent application can only be implemented in the $TE_{011}$ mode or in modes featured by a negligible electrical field E (even in its right angle composition) in the proximity of the metal surfaces delimiting the cavity itself.

(3) Reduction of weight and sizes, thus achieving more application flexibility presenting new and considerable possibilities e.g. to obtain fixed frequency oscillators directly at microwaves thus overcoming difficulties of components or spare parts which usually are necessary in traditional solutions.

The several aspects and advantages of the ivention are better evidenced by the following description of the embodiments represented in the attached drawings in which:

FIGS. 2, 2A, 3A and 3B are schematic, partially exploded perspective views;

Figures 3, 3A, 3B:
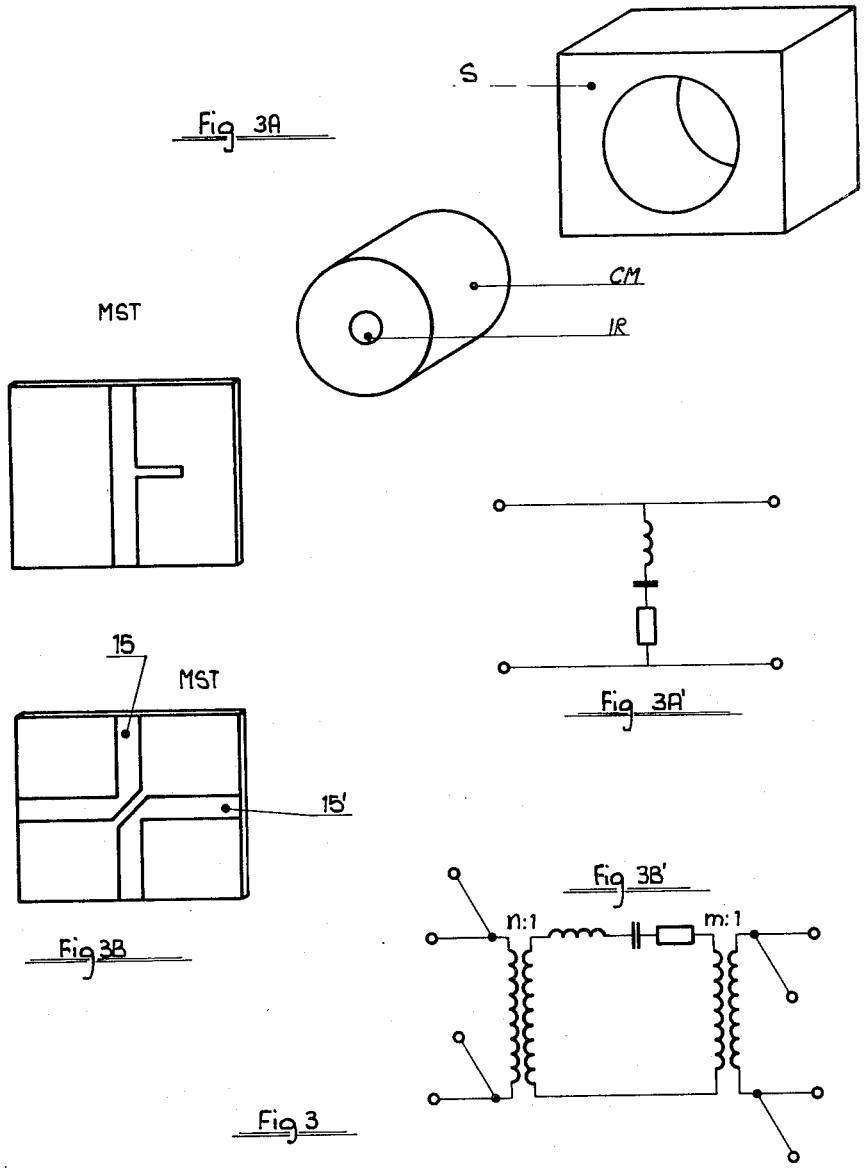

FIGS. 3A', 3B', 4, 4A and 5 are equivalent circuits, and

Figure 6:
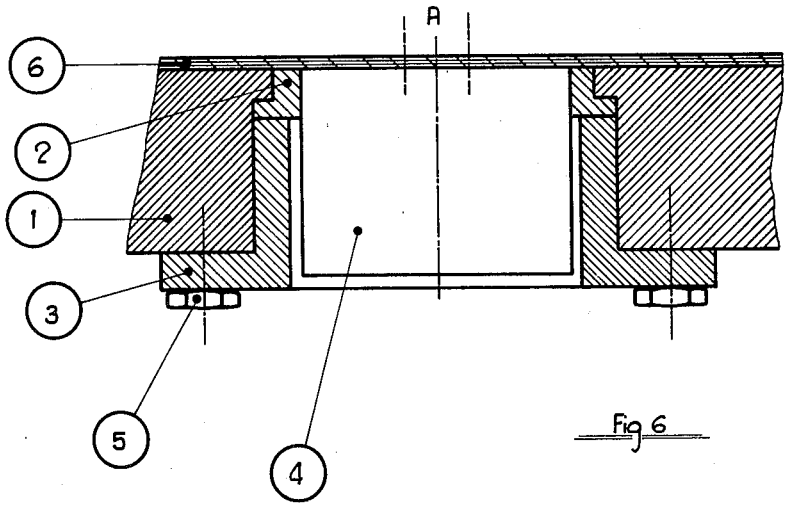

FIG. 6 is a schematic partially cross-sectioned top view of a particular embodiment.

Figure 1:
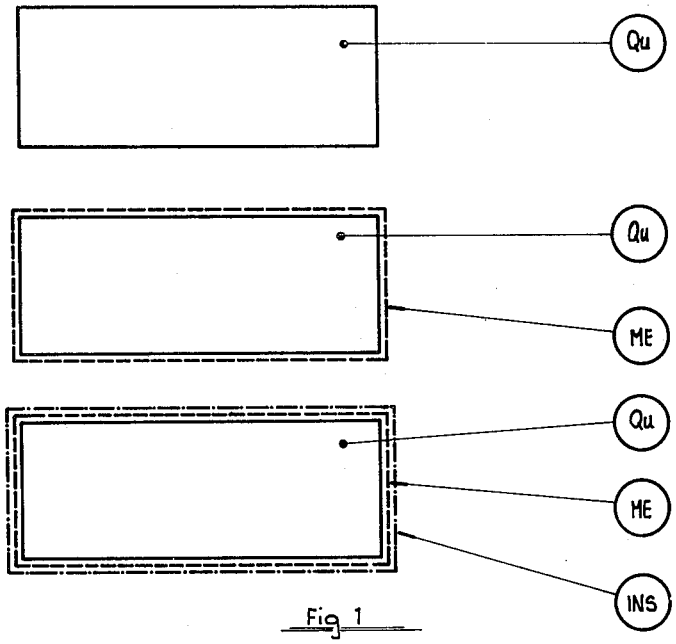
FIG. 1 is a simplified process scheme.

FIG. 1 is a simplified view of the cavities being prepared according to the invention.

Phase I: A quartz rod is cut into small quartz cylinders QU having the required dimensions (diameter and length).

Phase II: Metalling.

The external surface of QU is covered with a thin metal layer (ME) (preferably in the micron order) e.g. by diving or drowning it in a copper or in another conductive metal bath.

Phase III: Quartz cylinder QU thus covered by a thin metal layer is provided with a second layer INS (a socalled thickening layer) of a metal which is either the same or it is different from metal layer ME.

Thickening layer INS is preferred to be in the order of a tenth part of a mm and it should be applied by a galvanic bath. It is outlined that layers ME (phase II) and INS (phase III) may also be applied in a different way e.g. by brushing it with conducting paints (copper, silver or similar) or by brushing followed by a galvanic bath. In all cases the following characteristics must be attained.

Quartz quality: use is made of pure amorphous quartz, preferably of optical quality, obtained from rectified and worked rods.

Metallizing: this is to create around the quartz a high conductivity metal surface tightly connected to the quartz surface thus preventing air or other gas from being stored in the resonant cavity inside (i.e. the quartz volume inside the metal surface).

The first metal layer which is to assure a high electric conductivity and a thickness able to contain the total electric current associated to the resonant electromagnetic field is covered by conducting material INS preferably by means of a galvanic procedure so as to increase mechanical strength. This will facilitate mechanical and electrical connections to the active device or to the coupled devices to which the cavities must supply the required electrical characteristics.

FIGS. 2, 3A and 3B (being schematic, partial and exploded views respectively) illustrate three types of coupling between cavities $C_M$ of the invention and the microstrip MST. In FIG. 2 "L" represents the transmission line with its dielectric support, whilst FCC is the element assuring the electrical continuity of the assembly, CAL is an aluminum body consisting of a plate CAL' bearing a support base CAL" (in a right angle position with respect to CAL') and of pin CIN being in a right angle position with respect to CAL' as well. The metallized and reinforced cavity CM according to the invention is cylinder shaped and provided with a hole 10 in the middle which may receive and hold nut 11 of threaded pin CIN.

CM is a $\lambda/2$ coaxial cavity with a hole $F_{SO}$ receiving probe SO coupling the $\lambda/2$ cavity to the microstrip MST.

Pin CIN is preferred to be of Invar. FIG. 2A represents an assembly of the several elements, whilst FIG. 2 is an exploded view of the loose elements.

FIG. 3A illustrates a scheme of the microstrip coupling towards circular cavity CM via iris IR.

FIG. 3A' shows the equivalent circuit of the above microstrip coupling towards the cavity via iris CM.

FIG. 3B represents the case wherein the unique microstrip MST of FIG. 2A is substituted by microstrip MST' with two connections 15—15'; one of these connections may be used for the fine adjustment of the CM cavity resonance frequency similar to the one shown in FIG. 2A.

FIG. 3B' represents the equivalent scheme of FIG. 3B with the microstrip connections 15—15' coupled to the CM cavities via iris IR, in that the CM cavity is inserted into its hollow support S.

The above clearly evidences that one of the most advantageous aspects of the cavities of the invention is that they are intrinsically fixed frequency cavities, hence by coupling them to an active circuit they may profitably used for stable oscillators.

For an utmost cost saving of the quartz mechanical procedure a frequency fine adjustment is envisaged, which is made possible by a weak coupling to a suitable reactive network that may consist of semiconductor devices.

Couplings to the cavities: even if inductive couplings are possible, capacitive couplings or anyway electric field E type couplings turn out to be very advantageous and so are especially the two possibilities of FIGS. 2 and 3A ie:

capacitive coupling via a probe inserted in a hole recessed in the quartz and glued with artificial resins. Probe SO of FIG. 2 is preferred to be of a metal alloy with a low expansion and its surface treated so as to increase its conductivity.

The probe can also be obtained by metallization.

Electric field coupling via iris IR (FIG. 3A) obtained from the quartz metallized surface by removing metal of a suitable area.

Manufacturing of oscillators stabilized by the cavities of this invention is particularly interesting. The active device coupled to the cavity may be set up by means of semiconductor elements such as bipolar transistors, FETs, Gunn diodes etc. The cavity position may have various configurations e.g. series-connected to the load, parallel connected to the load, in feedback, parallel connected to the active element etc.

An outstanding feature is the possibility of changing the oscillator frequency by simply replacing the resonant cavity by another one having slightly different dimensions, whilst the active circuit remains unaltered. To this effect, a network is to be inserted and integrated to the active device; by means of a weak cavity coupling this network permits a resonant frequency fine adjustment of the cavity itself.

Figure 4:
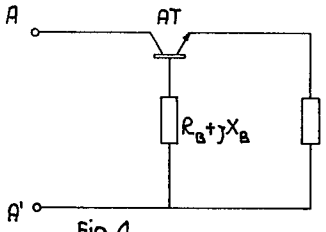
Figure 4A:
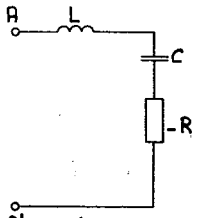

Hereunder follows an example of stable oscillators made according to the above described techniques and provided with cavities of this invention:

FIG. 4 shows a device on microstrip MST consisting of active bipolar element AT. The device may be laid out with a serial LC resonant circuit with negative resistance (−R) and a low Q. Via iris IR a circular cavity according to the invention is connected to this device and for dimensioning reasons it is energized in the $TM_{010}$ mode.

Also a reactive circuit is weakly coupled through the same iris. This circuit too is arranged on a plate of the active device (coupling as shown in FIG. 3B).

Figure 5:
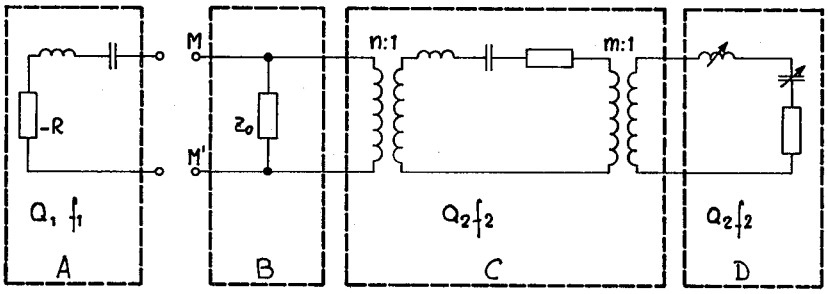

The equivalent circuit may be as the one shown in FIG. 5 wherein the symbols mean what follows:

A=Active device, B=Load, C=Resonant Cavity, D=fine adjustment.

If $Q_2 >> Q_1 |f2-f1| < Kf_o$ with $K << 1$ and if $|-R| < Z_o$, by duly varying coupling (n:1) the oscillating conditions at strips MM' are reached ie:

$$Z_o // R_{eq} = |-R| X_{eq} = -X$$

The device mechanical configuration is shown if FIG. 6 and is such that the oscillating frequency can be changed by simply replacing the cavity. The symbols in FIG. 6 mean what follows:

(1)=aluminum body; (2)=ring soldered to cavity (4); (3)=rods; (4)=cavity provided with ring (2); (5)=screws; (6)=microstrip; (A)=coupling area.

Invar ring (2) is soldered to cavity (4) beating with device body (1) (beating is done by means of rods (3) or similar) assuring the cavity mechanical position referred to the coupling hole axis and earth continuity.

It is evident that the invention is not limited to the embodiments described, but it can undergo all the variations obvious to a person skilled in the art, e.g. its vest may be applied in one single phase instead of in two or three phases.

We claim:

1. A resonant cavity comprising a hollow body of pure amorphous quartz covered with a first thin layer of highly conductive metal and a second thickening metal layer, and further comprising active circuit oscillator means and coupling means for coupling the resonant cavity to said oscillator means to stabilize the oscillator means frequency with respect to the cavity frequency.

2. A method for preparing a resonant microwave cavity comprising the steps of: cutting a quartz rod into small rod sections having predetermined dimensions; applying a first relatively thin metal layer on the small rod sections; and applying a second thicker metal layer over said first thin metal layer, wherein said first thin metal layer is applied by submerging the rod sections in a conductive metal bath.

3. The method according to claim 2 wherein the second metal layer is applied galvanically.

4. A method for preparing a resonant microwave cavity comprising the steps of: cutting a quartz rod into small rod sections having predetermined dimensions; applying a first relatively thin metal layer on the small rod sections; and applying a second thicker metal layer over said first thin metal layer, wherein the first thin metal layer is applied by brushing the rod sections with a metal paint.

5. The method according to claim 4 wherein the second metal layer is applied galvanically.

* * * * *